United States Patent [19]

Stenqvist

[11] Patent Number: 5,009,159

[45] Date of Patent: Apr. 23, 1991

[54] PRINTING UNIT

[76] Inventor: Jan N. Stenqvist, Mosshult 3580, S-260, 60 Kvidinge, Sweden

[21] Appl. No.: 382,691

[22] PCT Filed: Feb. 12, 1988

[86] PCT No.: PCT/SE88/00052

§ 371 Date: Aug. 10, 1989

§ 102(e) Date: Aug. 10, 1989

[87] PCT Pub. No.: WO88/06097

PCT Pub. Date: Aug. 25, 1988

[30] Foreign Application Priority Data

Feb. 13, 1987 [SE] Sweden ..... 8700575

[51] Int. Cl.[5] ..... B41F 31/04; B41F 31/34; B41F 31/06; B41L 27/36

[52] U.S. Cl. ..... 101/351; 101/169

[58] Field of Search ..... 101/351, 352, 349, 350, 101/247, 207-210, 157, 169, 247, 161

[56] References Cited

U.S. PATENT DOCUMENTS 4,458,590 7/1984 Egnaczak ..... 101/247

FOREIGN PATENT DOCUMENTS 2746878 4/1979 Fed. Rep. of Germany ..... 101/247

*Primary Examiner*—J. Reed Fisher

*Attorney, Agent, or Firm*—Barnes, Kisselle, Raisch, Choate, Whittemore & Hulbert

[57] ABSTRACT

A printing unit comprises an impression cylinder (3) and an inking roller (4) adjustably spaced from the impression cylinder (3) by means of a pair of first lever arms (10) which are pivotal and eccentrically mounted in relation to the axis of rotation (18) of the roller (4). An elongate doctor blade (8) for wipe-off engagement with the roller (4) is supported by a pair of second pivotal lever arms (19) which are concentrically mounted in relation to the axis of rotation (18) of the roller (4) and eccentrically mounted in relation to the fulcrum (15) of the first lever arms (10), whereby the doctor blade (8) and the roller (4) maintain their relative positions during the adjustment of the spacing between the roller (4) and the impression cylinder (3). Thus, the doctor blade (8) follows the movements of the inking roller (4) while maintaining the parallelism between them. The pivotment and the setting of the lever arms (10) and (19) are brought about by adjusting devices (16) and (23), respectively.

7 Claims, 2 Drawing Sheets

PRINTING UNIT

The present invention relates to a printing unit comprising a rotary impression cylinder and a likewise rotary inking roller included in an inking device and adjustably spaced from said impression cylinder by means of a first lever device which is pivotal and eccentrically mounted in relation to the axis of rotation of said inking roller, the printing unit further having a doctor blade movable into wipe-off engagement with the inking roller.

A printing unit of this type is previously known from SE Patent Application 8304024-6 which is hereby included by reference. Although the object of the invention disclosed in this SE patent application is completely different from that of the present invention, the printing unit per se is of the same basic design. The printing unit includes a back pressure cylinder, an impression cylinder and an inking roller, all of which are rotatable, parallel to and adjustably spaced from each other. A fountain roller dips into an ink container and, during its rotation, deposits ink on the inking roller.

In recent years, new types of printing units have been developed in which the inking roller has been provided with a screen and the ink container is disposed directly underneath the inking roller which will thus at the same time serve as fountain roller. The excess ink drawn up from the ink container by the fountain roller must be scraped or wiped off by means of an elongate doctor blade engaging the fountain roller. The purpose is to ensure that the ink deposited on the inking roller forms a relatively thin layer. It has thus become even more vital that the excess ink be properly and accurately wiped off, for which reason the location and the design of the doctor blade have attracted increasingly greater attention.

In printing units of the above-mentioned type, use is often made of an elongate doctor blade which is mounted on the machine frame parallel to the inking roller and is movable into engagement therewith. However, this printing unit suffers from a number of drawbacks, especially in respect of the operation of the doctor blade.

During printing, it must be possible to adjust the spacings between the back pressure cylinder, the impression cylinder and the inking roller because of unevennesses in or wear of the printing block or varying thickness of the web to be printed. Since the doctor blade is mounted directly on the machine frame, there is no adaptation between the movements of the inking roller and the doctor blade. For each adjustment of the inking roller, the doctor blade must be reset by means of separate adjusting devices which are often insufficiently accurate. This procedure is complicated and also gives rise to such drawbacks as an uneven ink layer on the inking roller, uneven wear of both the doctor blade and the inking roller etc.

One object of the present invention therefore is to provide a printing unit in which the inking roller and the doctor blade are adjustable in a simple and accurate manner so as to overcome or at least substantially reduce the above-mentioned shortcomings.

Another object is to provide a printing unit in which the inking roller and the doctor blade constantly maintain their relative positions when adjusting the spacing between them or relative to other rollers and cylinders included in the printing unit.

A further object is to provide a printing unit which ensures even deposition of ink on the inking roller by means of the doctor blade.

These and other objects, which will appear from the following description, have now been achieved according to the invention by means of the printing unit stated in the introduction to this specification, which is characterized by a second pivotal lever device concentrically mounted in relation to the axis of rotation of the inking roller and eccentrically mounted in relation to the pivot axis of the first lever device, and that said doctor blade is supported by said second lever device, whereby the doctor blade and the inking roller will maintain their relative positions when adjusting the spacing between the inking roller and the impression cylinder.

Preferred embodiments of the invention are stated in the accompanying subclaims.

The invention will now be described in more detail hereinafter with reference to the accompanying drawings showing a currently preferred embodiment of a printing unit according to the invention.

Figure 1:
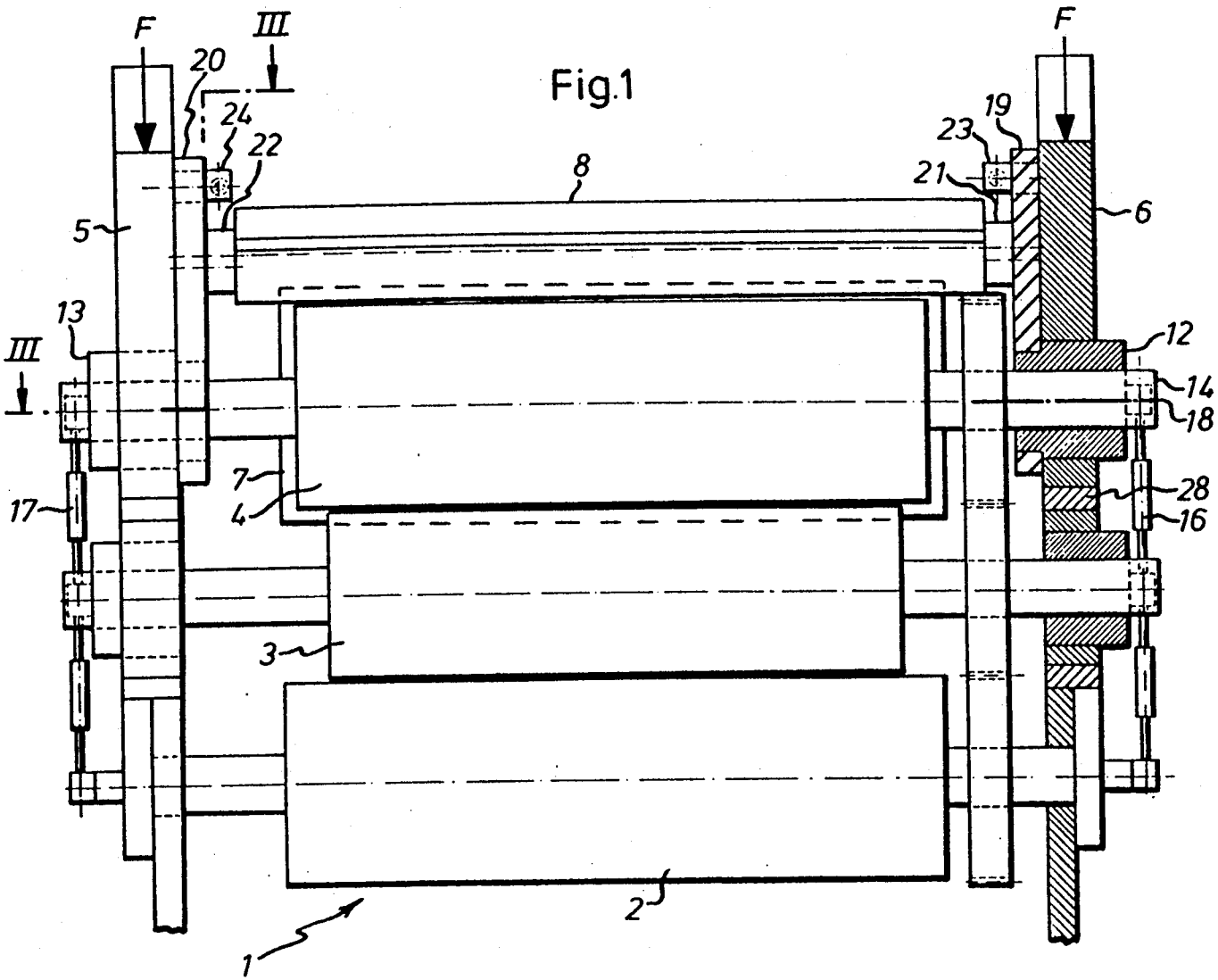
FIG. 1 shows the printing unit according to the invention from above with certain parts in section.

In FIG. 1, a printing unit according to the invention generally designated 1 comprises rotary, parallel and adjustably spaced main components being a back pressure cylinder 2, an impression cylinder 3 and an inking roller 4 which are all mounted on a machine frame and more specifically in bearing brackets 5 and 6, respectively. It should be noted that the bearing bracket 6 is shown in section in a plane extending through said main components 2–4.

Below the inking roller 4, there is provided an ink container 7 from which ink is drawn up by the roller 4 and applied to the impression cylinder 3 in a known manner. An elongate doctor blade 8 which is rotatable about its longitudinal axis is disposed behind and parallel to the inking roller 4. By being rotatable, the doctor blade 8 is biased so as to engage the inking roller 4 for wiping off ink drawn up from the ink container 7.

By means of a power unit (not described in more detail), the bearing brackets 5, 6 are biased against the frame part carrying the back pressure cylinder 2. The power unit, of which an example is stated in the above-mentioned SE Patent Application 8304024-6, is schematically symbolized by arrows F.

Figure 2:
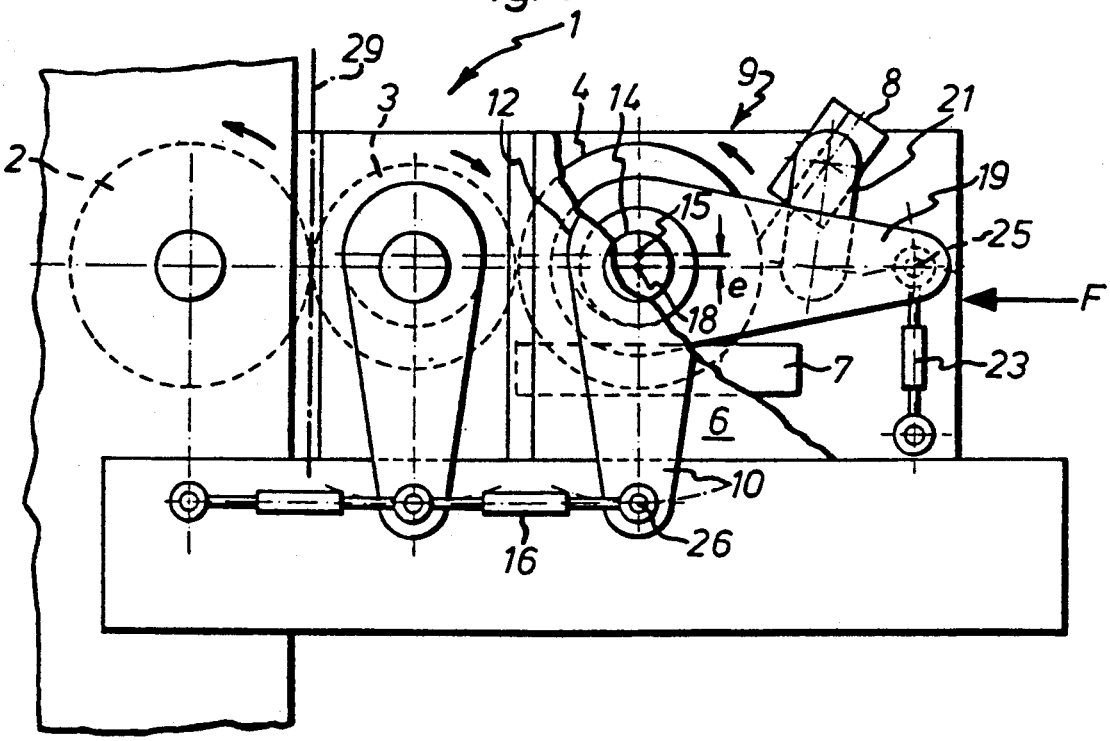
FIG. 2 shows the printing unit from the side with certain parts removed.

In FIG. 2, to which reference is now made, the printing unit 1 is shown from the side. For greater clarity, parts of the bearing bracket 6 have been removed in the area of an inking device 9 comprising the roller 4, the container 7 and the doctor blade 8. The spacing of the inking roller 4 in relation to the impression cylinder 3 can be adjusted by means of two first, parallel and individually pivotal lever arms 10, 11 (only one of which is shown in FIG. 2), each mounted via an eccentric bushing 12 and 13, respectively (see FIG. 1), about the shaft 14 of the inking roller 4. The lever arms 10, 11 are pivoted about fulcrums 15 by operating adjusting devices 16 and 17, respectively, which are hingedly connected to the lever arms and, via components in the form of additional lever arms and adjusting devices (not shown in more detail), connected to the machine frame. The fulcrum 15 is spaced a distance e from the axis of rotation 18 of the inking roller 4, e thus representing the eccentricity of the lever arms 10, 11.

Two second, parallel and individually pivotal lever arms 19 and 20 are mounted about the shaft 14 of the inking roller 4, as will be described in more detail further on. The doctor blade 8 is mounted between the second lever arms 19, 20 by means of holders 21, 22. As in the case of the first lever arms 10, 11, adjusting devices 23, 24 hingedly connected to the free end portions of the second lever arms 19, 20 are mounted in the bearing brackets 5, 6. It should be noted that the hinge point 25 of the adjusting device 23 on the lever arm 19 is located on a level with the axis of rotation 18 of the inking roller 4. The same applies to the lever arm 20. Further, it should be noted that the hinge point 26 of the adjusting device 16 on the lever arm 10 is aligned with both the axis of rotation 18 and the fulcrum 15. This, taken together, means that pivotal movement of the lever arms 10, 11 and 19, 20 brings about negligible displacements in the vertical direction of the second lever arms 19, 20, between which the doctor blade 8 is disposed.

Thus, the second lever arms 19, 20 are concentrically mounted in relation to the axis of rotation 18 of the inking roller 4 and eccentrically mounted in relation to the fulcrum 15 of the first lever arms 10, 11. When the spacing between the inking roller 4 and the impression cylinder 3 is adjusted, the doctor blade 8 and the inking roller 4 maintain their relative positions thanks to this special arrangement of lever arms mounted concentrically and eccentrically in relation to the axis of rotation 18 of the inking roller 4.

Figure 3:
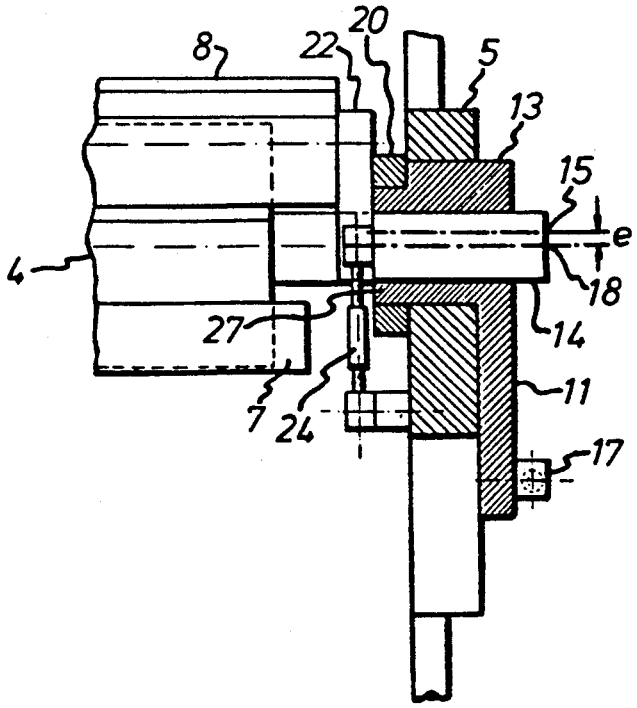
FIG. 3 is a view taken along the line III—III in FIG. 1 with certain parts in section.

FIG. 3 shows in detail how the inking roller 4 is mounted in the bearing bracket 5. The eccentric bushing 13 comprises a substantially tubular portion 27 extending inwards towards the end of the inking roller 4 and forming a bearing on which the lever arm 20 is mounted. This figure also clearly shows the eccentricity e between the fulcrum or pivot axis 15 of the first lever arms 10, 11 and the fulcrum or pivot axis of the second lever arms 19, 20, the latter fulcrum or pivot axis coinciding with the axis or centre of rotation 18 of the inking roller 4.

Finally, as regards dimensioning, it has been found advantageous in practical tests to use a spacing between the fulcrum of the second lever arms 19, 20 and the hinge points 25 of the associated adjusting devices 23, 24 that is of the same order as the diameter of the roller 4. Further, the eccentricity e should be considerably less than said spacing, preferably according to an approximate ratio of 1:20, whereby the vertical displacement of the second lever arms 19, 20 becomes negligible.

According to a variant of the invention which is not described in more detail or illustrated in the drawings, the second lever arms 19, 20 are mounted directly on the shaft 14 of the inking roller 4, the tubular portions 27 of the eccentric bushings 12, 13 preferably being replaced by bearings (not shown).

According to another variant of the invention, the second lever arms 19, 20 and the bearing brackets 5, 6 are interconnected by means of a respective rod (not shown). These two rods, which thus extend parallel to the roller and the cylinders of the printing unit, are preferably mounted at the locations where the ends of the adjusting devices 23, 24 are fixed to the bearing brackets 5, 6 and the second lever arms 19, 20, respectively (see FIG. 3). In this manner, the two adjusting devices 23, 24 may, if so desired, be replaced by a single adjusting device (not shown) disposed midway between the bearing brackets 5, 6 and mounted between the above-mentioned rods (not shown).

It should also be pointed out that, under certain circumstances, the present invention is also applicable to conventional printing units where the inking roller and the doctor blade are mounted directly on the bearing brackets.

Thus, the invention should not be considered restricted to the embodiment described above but may be modified in several different ways within the spirit and scope of the accompanying claims. For instance, the bearing brackets 5, 6 may be designed otherwise, with or without gauge blocks 28 (see FIG. 1) serving as spacer means and intentionally not discussed in more detail in this specification. Further, the web 29 (see FIG. 2) on which a pressure should be exerted has not been described in more detail here either, since it can be fed into the printing unit at different locations and, possibly, by means of further rollers.

I claim:

1. A printing unit (1) comprising a rotary impression cylinder (3), an inking device (9), a rotary inking roller (4) in said inking device, said impression cylinder and inking device being mounted on a machine frame, said inking roller (4) having an axis of rotation (18) defining a shaft, means for adjusting said inking roller toward and away from said impression cylinder, said means including a first lever device (10, 11) which is pivotal about a pivot axis (15) and eccentrically mounted in relation to the axis of rotation (18) of said inking roller, said inking roller being mounted and rotatably supported by said first lever device, the printing unit (1) further having a doctor blade (8) movable into wipe-off engagement with the inking roller (4), a second pivotal lever device (19, 20) concentrically mounted in relation to the axis of rotation (8) of the inking roller (4) and eccentrically mounted for pivotal movement in relation to the pivot axis (15) of the first lever device (10, 11), said doctor blade (8) being mounted on and supported by said second lever device (19, 20), whereby the doctor blade (8) and the inking roller (4) will maintain their relative positions when adjusting the spacing between the inking roller (4) and the impression cylinder (3) by displacement of said first lever device (10, 11).

2. Printing unit as claimed in claim 1, in which the first lever device comprises two parallel, individually pivotal lever arms (10, 11), respective eccentric bushings (12, 13) provided around the shaft (14) of the inking roller (4) for mounting the lever arms (10, 11) on a machine frame (5, 6) at each end of the roller and extend radially outwardly away from said roller, said lever arms (10, 11) having free end portions hingedly connected each to a first adjusting device (16, 17) mounted on the machine frame for bringing about said adjustment of the spacing between the inking roller (4) and the impression cylinder (3), said second lever device comprising two parallel, individually pivotal lever arms (19, 20), respective bearing means (27) provided around the shaft (14) of the inking roller (4), said pivotal levers of said second lever device being mounted on the machine frame (5, 6) at each end of said roller, a second adjusting device (23, 24), said lever arms (19, 20) of said second lever device having free end portions which extend radially outwardly away from the roller, and are hingedly connected each to said second adjusting device (23, 24) mounted on the machine frame for bringing about further adjustment of the inking roller (4) and, thus, of the doctor blade (8) which is disposed between said second lever arms (19, 20).

3. Printing unit as claimed in claim 2, wherein the first lever arms (10, 11) have fulcrums (15) which are each substantially aligned with the axis of rotation (18) of the inking roller (4), said first adjusting device having a hinge point (26) on said associated lever arms (10, 11) on the first lever arms (10, 11), said second adjusting device having a hinge point (25) on said second lever arms (19, 20), said second lever arms (19, 20) having fulcrums which are each substantially aligned with the hinge point (25) of the associated second adjusting device (23, 24) on the second lever arms (19, 20) and coincide with the axis of rotation (18) of the inking roller (4).

4. Printing unit as claimed in claim 3, wherein said first and second lever arms (10, 11 and 19, 20, respectively) form an angle of about 90° with each other, and that the first adjusting device (16, 17) are substantially perpendicular to the longitudinal direction of the first lever arms (10, 11) while the second adjusting devices (23, 24) are substantially perpendicular to the longitudinal direction of the second lever arms (19, 20).

5. Printing unit as claimed in claim 4, wherein the spacing between the fulcrums (15) of the first lever arms (10, 11) and the axis of rotation 910) of the inking roller (4), the eccentricity (e), is considerably smaller than the spacing between the axis of rotation (18) of the inking roller (4) and the hinge point (25) of the second adjusting devices (23, 24) on the respective second lever arms (19, 20).

6. Printing unit as claimed in claim 5, wherein the first lever arms (10, 11) are mounted in bearing brackets (5, 6) in the machine frame by means of the respective eccentric bushings (12, 13) through which the shaft (14) of the inking roller (4) extends and which has a substantially tubular portion (27) extending inwardly toward the end of the inking roller (4) and forming said bearing means for the associated second lever arms (19, 20).

7. Printing unit as claimed in claim 1, wherein the doctor blade (8) has a longitudinal axis and is so mounted on the second lever device (19, 20) that it is rotatable about its longitudinal axis for bringing about biased engagement against the inking roller (4).

* * * * *